US007710367B2

(12) United States Patent
Choi

(10) Patent No.: US 7,710,367 B2
(45) Date of Patent: May 4, 2010

(54) ORGANIC LIGHT EMITTING DISPLAY AND METHOD OF DRIVING THE SAME

(75) Inventor: Sang Moo Choi, Suwon (KR)

(73) Assignee: Samsung Mobile Display Co., Ltd., Yongin (KR)

( * ) Notice: Subject to any disclaimer, the term of this patent is extended or adjusted under 35 U.S.C. 154(b) by 1001 days.

(21) Appl. No.: 11/274,208

(22) Filed: Nov. 16, 2005

(65) Prior Publication Data

US 2006/0103611 A1 May 18, 2006

(30) Foreign Application Priority Data

Nov. 17, 2004 (KR) ..... 10-2004-0094122

(51) Int. Cl.
*G09G 3/32* (2006.01)

(52) U.S. Cl. ..... 345/82

(58) Field of Classification Search ..... 345/204, 345/82, 88, 95–96, 208–209, 211, 213
See application file for complete search history.

(56) References Cited

U.S. PATENT DOCUMENTS 6,236,380 B1 5/2001 Wani et al.
2003/0169247 A1* 9/2003 Kawabe et al. ..... 345/204
2004/0201581 A1* 10/2004 Miyazawa ..... 345/204
2005/0046619 A1* 3/2005 Senda et al. ..... 345/76
2006/0097965 A1* 5/2006 Deane et al. ..... 345/76

FOREIGN PATENT DOCUMENTS

| | | |
|---|---|---|
| CN | 1490779 | 4/2004 |
| CN | 1770237 | 5/2006 |
| JP | 2000-122600 | 4/2000 |
| JP | 2004-294752 | 10/2004 |
| JP | 2004-302023 | 10/2004 |

* cited by examiner

*Primary Examiner*—Richard Hjerpe
*Assistant Examiner*—Shaheda A Abdin
(74) *Attorney, Agent, or Firm*—H.C. Park & Associates, PLC

(57) ABSTRACT

An organic light emitting display including a scan driver for supplying scan signals to odd scan lines in an $i^{th}$ frame and for supplying scan signals to even scan lines in an $(i+1)^{th}$ frame, a data driver for supplying data signals corresponding to the scan signals, and an image display unit including a plurality of pixels coupled with the scan lines and the data lines. Pixels coupled with the odd scan lines do not emit light when the scan signals are supplied to the odd scan lines, and pixels coupled with the even scan lines do not emit light when the scan signals are supplied to the even scan lines.

23 Claims, 13 Drawing Sheets

■ : NON-EMISSION □ : EMISSION

■ : NON-EMISSION □ : EMISSION

■ : NON-EMISSION □ : EMISSION

■ : NON-EMISSION □ : EMISSION

ORGANIC LIGHT EMITTING DISPLAY AND METHOD OF DRIVING THE SAME

CROSS-REFERENCE TO RELATED APPLICATIONS

This application claims priority to and the benefit of Korean Patent Application No. 10-2004-0094122, filed on Nov. 17, 2004, which is hereby incorporated by reference for all purposes as if fully set forth herein.

BACKGROUND OF THE INVENTION

1. Field of the Invention

The present invention relates to an organic light emitting display and a method of driving the same, and more particularly, to an organic light emitting display having improved display quality.

2. Discussion of the Background

Various thin and lightweight flat panel displays (FPD) have been developed to replace cathode ray tubes (CRT). Such FPDs include liquid crystal displays (LCD), field emission displays (FED), plasma display panels (PDP), and organic light emitting displays.

Generally, organic light emitting displays display images using organic light emitting diodes (OLED), which generate light by re-combination of electrons and holes. Organic light emitting displays typically have high response speed and low power consumption.

FIG. 1 shows a conventional organic light emitting display.

Referring to FIG. 1, the conventional organic light emitting display includes an image display unit 30 including pixels 40 formed at crossings of scan lines S1 to Sn and data lines D1 to Dm, a scan driver 10 for driving the scan lines S1 to Sn, a data driver 20 for driving the data lines D1 to Dm, and a timing controller 50 for controlling the scan and data drivers 10 and 20.

The scan driver 10 generates scan signals in response to scan driving control signals SCS from the timing controller 50 and sequentially supplies the scan signals to the scan lines S1 to Sn. The scan driver 10 also generates emission control signals in response to the scan driving control signals SCS and sequentially supplies the emission control signals to emission control lines E1 to En.

The data driver 20 generates data signals in response to data driving control signals DCS from the timing controller 50 and supplies the data signals to the data lines D1 to Dm. The data driver 20 supplies the data signals for one horizontal line to the data lines D1 to Dm every one horizontal period.

The timing controller 50 generates the data driving control signals DCS and the scan driving control signals SCS in response to input synchronizing signals. The timing controller 50 supplies the data driving control signals DCS to the data driver 20 and the scan driving control signals SCS to the scan driver 10. The timing controller 50 re-aligns data Data supplied from the outside and supplies the data Data to the data driver 20.

The image display unit 30 is coupled with a first power source ELVDD and a second power source ELVSS, which are supplied to the pixels 40. The pixels 40 display images corresponding to the data signals supplied thereto. The emission time of the pixels 40 is controlled by the emission control signals.

Here, the emission control signals are sequentially supplied to the first to nth emission control lines E1 to En together with the scan signals. Therefore, all of the pixels 40 included in the image display unit 30 emit light except for the short time during which the emission control signals are supplied.

However, the voltage of the first power source ELVDD may change in accordance with whether the pixels 40 emit light, that is, in accordance with the pattern and brightness of the images displayed by the image display unit 30. To be specific, the load applied to the first power source ELVDD in one frame varies with whether the pixels 40 emit light. Hence, when a large number of pixels 40 emit light in one frame, a large load is applied to the first power source ELVDD. On the other hand, when a small number of pixels 40 emit light in one frame, a small load is applied to the first power source ELVDD. Therefore, the voltage of the first power source ELVDD may change to correspond to the load. In this case, it may not be possible to display images with uniform brightness.

SUMMARY OF THE INVENTION

The present invention provides a organic light emitting display capable of improving display quality and a method of driving the same.

Additional features of the invention will be set forth in the description which follows, and in part will be apparent from the description, or may be learned by practice of the invention.

The present invention discloses an organic light emitting display including a scan driver for sequentially supplying scan signals to odd scan lines in an $i^{th}$ (i is a natural number) frame and for sequentially supplying scan signals to even scan lines in an $(i+1)^{th}$ frame, a data driver for supplying data signals corresponding to the scan signals supplied to the odd scan lines in the $i^{th}$ frame and for supplying data signals corresponding to the scan signals supplied to the even scan lines in the $(i+1)^{th}$ frame, and an image display unit including a plurality of pixels coupled with the scan lines and the data lines. The scan driver supplies emission control signals to odd emission control signal lines so that pixels coupled with the odd scan lines do not emit light in a period where the scan signals are supplied to the odd scan lines and supplies emission control signals to even emission control signal lines so that pixels coupled with the even scan lines do not emit light in a period where the scan signals are supplied to the even scan lines.

The present invention also discloses a method of driving an organic light emitting display including supplying scan signals to odd scan lines in an $i^{th}$ (i is a natural number) frame, not emitting light from pixels coupled with the odd scan lines in a period where the scan signals are supplied to the odd scan lines, supplying scan signals to even scan lines in an $(i+1)^{th}$ frame, and not emitting light from pixels coupled with the even scan lines in a period where the scan signals are supplied to the even scan lines.

The present invention also discloses a method of driving an organic light emitting display including emitting light from first pixels in a period where scan signals are supplied in a first frame, and emitting light from second pixels in a period where scan signals are supplied in a second frame. The first pixels and the second pixels are exclusive of each other.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention, and together with the description serve to explain the principles of the invention.

DETAILED DESCRIPTION OF THE ILLUSTRATED EMBODIMENTS

Figure 1:
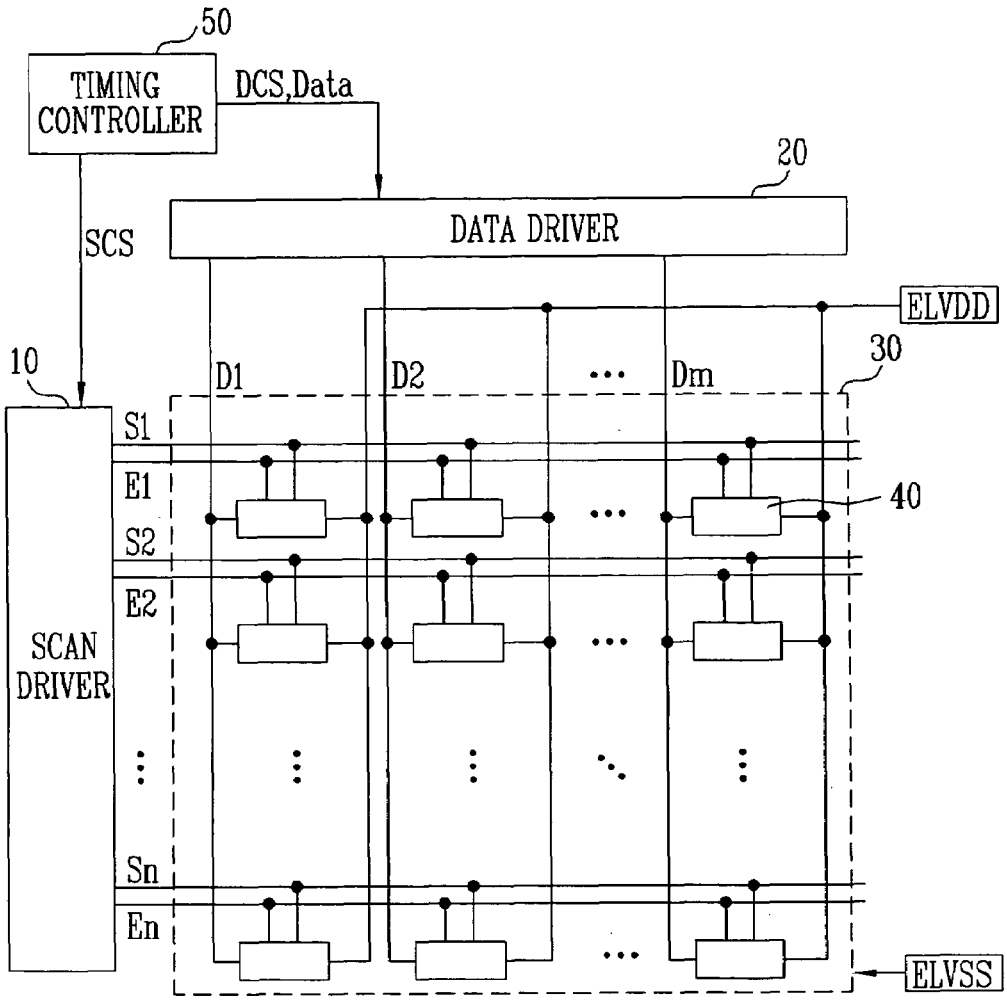
FIG. 1 (PRIOR ART)
FIG. 1 shows a conventional organic light emitting display.

The invention is described more fully hereinafter with reference to the accompanying drawings, in which embodiments of the invention are shown. This invention may, however, be embodied in many different forms and should not be construed as limited to the embodiments set forth herein. Rather, these embodiments are provided so that this disclosure is thorough, and will fully convey the scope of the invention to those skilled in the art. In the drawings, the size and relative sizes of layers and regions may be exaggerated for clarity.

Figure 2:
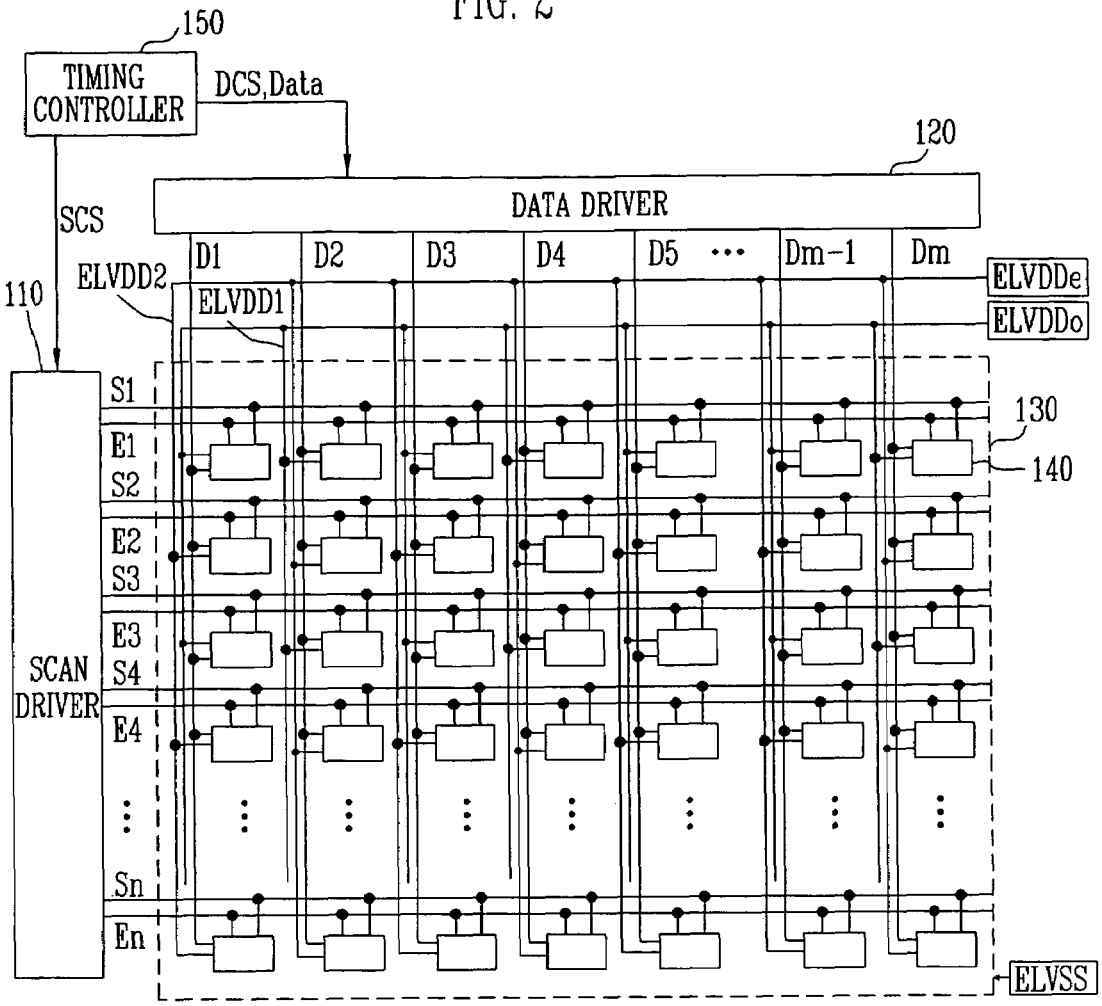
FIG. 2 shows an organic light emitting display according to a first exemplary embodiment of the present invention.

FIG. 2 shows an organic light emitting display according to a first exemplary embodiment of the present invention. Referring to FIG. 2, the organic light emitting display includes an image display unit 130 having pixels 140 arranged at crossings between scan lines S1 to Sn and data lines D1 to Dm, a scan driver 110 for driving the scan lines S1 to Sn, a data driver 120 for driving the data lines D1 to Dm, and a timing controller 150 for controlling the scan and data drivers 110 and 120.

Figure 5A:
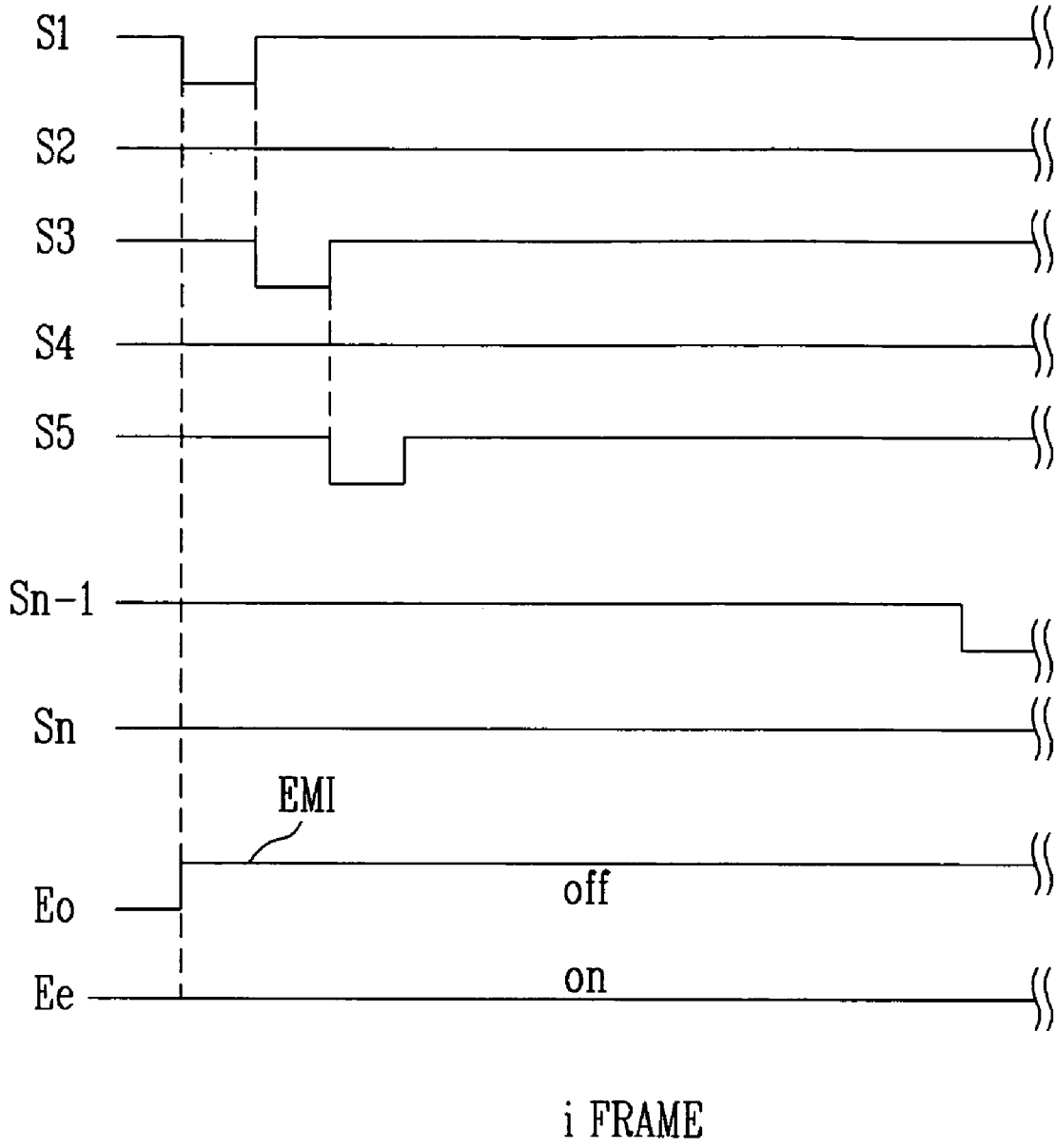
FIG. 5A and FIG. 5B show waveforms for describing a method of driving an organic light emitting display according to an exemplary embodiment of the present invention.
Figure 5B:
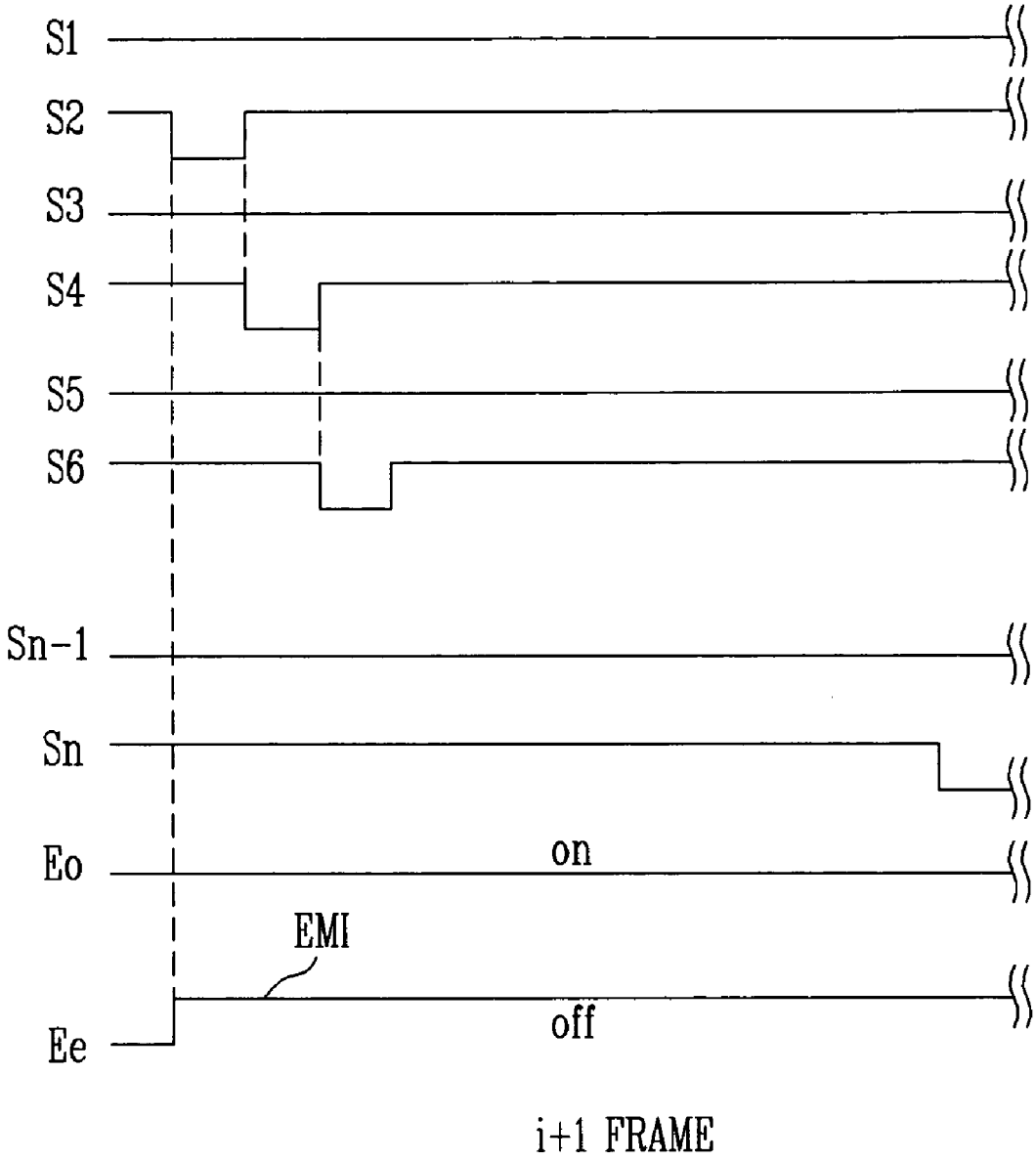

The scan driver 10 generates scan signals in response to scan driving control signals SCS from the timing controller 150 and supplies the scan signals to the scan lines. Here, the scan driver 110 may sequentially supply the scan signals to the odd scan lines S1, S3, S5, . . . in an $i^{th}$ (i is a natural number) frame, as shown in FIG. 5A, and to the even scan lines S2, S4, S6, . . . in an $(i+1)^{th}$ frame, as shown in FIG. 5B. The scan driver 110 also supplies emission control signals EMI to odd emission control signal lines E1, E3, E5, . . . in the $i^{th}$ frame and to even emission control signal lines E2, E4, E6, . . . in the $(i+1)^{th}$ frame.

The data driver 120 generates the data signals in response to data driving control signals DSC from the timing controller 150 and supplies the data signals to the data lines D1 to Dm. Here, the data driver 120 supplies the data signals for the pixels 140 of the odd horizontal lines in the $i^{th}$ frame and supplies the data signals for the pixels 140 of the even horizontal lines in the $(i+1)^{th}$ frame. Here, the pixels 140 of the odd horizontal lines are coupled with the odd scan lines S1, S3, S5, . . . and the odd emission control signal lines E1, E3, E5, . . . , and the pixels 140 of the even horizontal lines are coupled with the even scan lines S2, S4, S6, . . . and the even emission control signal lines E2, E4, E6,.

The timing controller 150 generates the data driving control signals DCS and the scan driving control signals SCS in response to input synchronizing signals and supplies the data driving control signals DCS to the data driver 120 and the scan driving control signals SCS to the scan driver 110. The timing controller 150 re-aligns input data Data to supply the data Data to the data driver 120.

The image display unit 130 includes the plurality of pixels 140 coupled with the scan lines S and the data lines D. The pixels 140 may be commonly coupled with a second power source ELVSS.

The pixels 140 of the odd horizontal lines are coupled with first power source lines ELVDD1, and the pixels 140 of the even horizontal lines are coupled with second power source lines ELVDD2. Here, the first power source lines ELVDD1 are coupled with a first power source ELVDDo, and the second power source lines ELVDD2 are coupled with a third power source ELVDDe. The first power source ELVDDo and the third power source ELVDDe may output substantially the same voltage. When the pixels 140 of the odd and even horizontal lines are coupled with power sources ELVDDo and ELVDDe, respectively, since currents do not flow through the power sources of the horizontal lines to which the data signals are not applied, voltages of the power sources do not change. When the voltages of the corresponding power sources change when light is emitted after supplying data signals, since the voltages corresponding to the data signals stored in the pixels also change by the amount of change in the voltages of the power sources due to coupling of storage capacitors, it may be possible to prevent non-uniform images due to change in the power source voltages.

Also, the number of pixels 140 coupled with the first or third power source ELVDDo or ELVDDe may be half the number of pixels coupled with the power source ELVDD of FIG. 1. Hence, the load value that changes in accordance with whether the pixels 140 emit light may be minimized. Accordingly, it is possible to reduce the amount of change in the voltages of the first and third power sources ELVDDo and ELVDDe as compared with conventional art.

Figure 3:
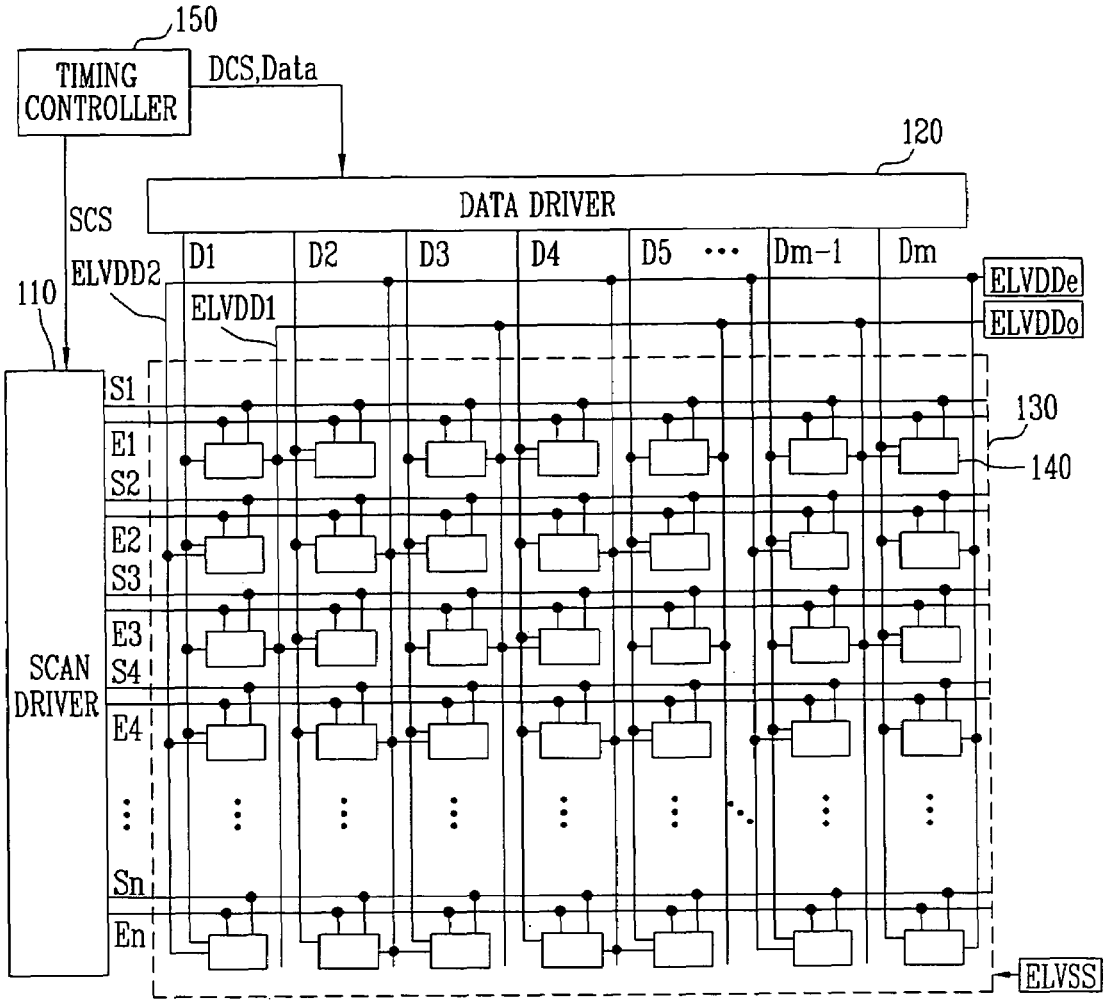
FIG.3 shows an organic light emitting display according to a second exemplary embodiment of the present invention.

Alternatively, as FIG. 3 shows, according to an exemplary embodiment of the present invention, the first and second power source lines ELVDD1 and ELVDD2 may each be coupled with two adjacent pixels 140. In this case, it is possible to reduce the number of first and second power source lines ELVDD1 and ELVDD2.

Figure 4:
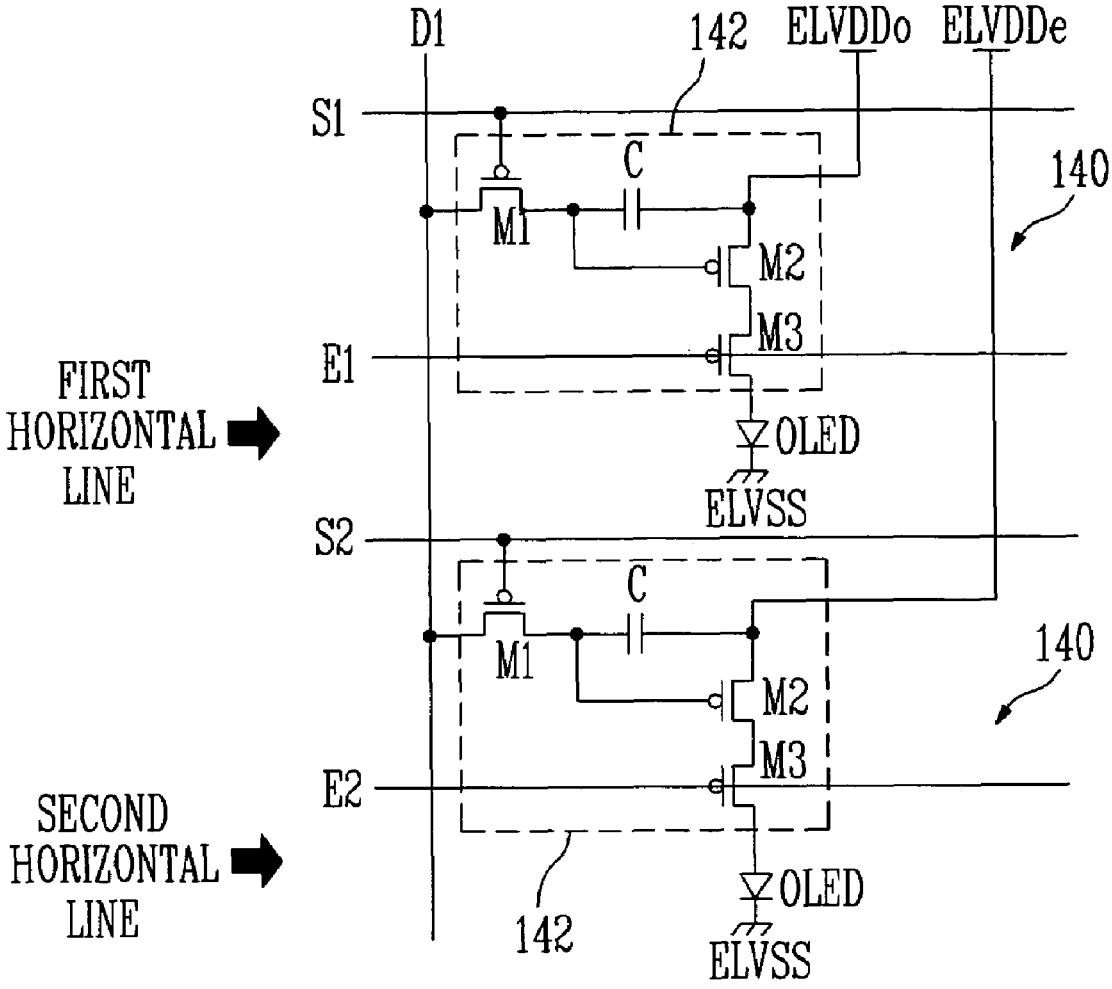
FIG. 4 shows an exemplary pixel structure for the pixels of FIG. 2.

FIG. 4 is a circuit diagram showing an example of a pixel structure that may be used for the pixels of FIG. 2 and FIG. 3. Here, various pixel structures including the emission control signal lines E may be used for the pixels 140.

Referring to FIG. 4, a pixel 140 includes an organic light emitting diode (OLED) and a pixel circuit 142. The pixel circuit 142 is coupled with a data line D, a scan line S, and an emission control signal line E to control the OLED.

The OLED's anode is coupled with the pixel circuit 142, and its cathode is coupled with the second power source ELVSS. The OLED generates light corresponding to the current supplied from the pixel circuit 142.

The pixel circuit 142 includes a first transistor M1, a second transistor M2, a third transistor M3, and a storage capacitor C. The first transistor M1 is turned on when a scan signal is supplied to the first scan line S1. When the first transistor M1 is turned on, the data signal supplied to the first data line D1 is supplied to an electrode of the storage capacitor C, which charges a voltage corresponding to the data signal.

The second transistor M2 supplies a current, corresponding to the voltage charged in the storage capacitor C, to the third transistor M3. The gate terminal of the third transistor M3 is coupled with the first emission control signal line E1, and the first terminal of the third transistor M3 is coupled with the second terminal of the second transistor M2. Here, when the first terminal of the third transistor M3 is a source terminal, the second terminal of the third transistor M3 is set as a drain terminal, and vice versa. The third transistor M3 is turned on when the emission control signal EMI is not supplied to the first emission control signal line E1, and it is turned off when the emission control signal EMI is supplied to the first emission control signal line E1. When the third transistor M3 is turned on, the current supplied from the second transistor M2 is supplied to the OLED to generate light of predetermined brightness.

FIG. 5A and FIG. 5B show driving waveforms that may be supplied to the pixels of FIG. 4.

Referring to FIG. 5A, scan signals are sequentially supplied to the odd scan lines S1, S3, S5, . . . in the $i^{th}$ frame. At this time, data signals corresponding to the scan signals supplied to the odd scan lines S1, S3, S5, . . . are supplied to the data lines D. Further, the emission control signals EMI are supplied to the odd emission control signal lines Eo.

Figure 6A:
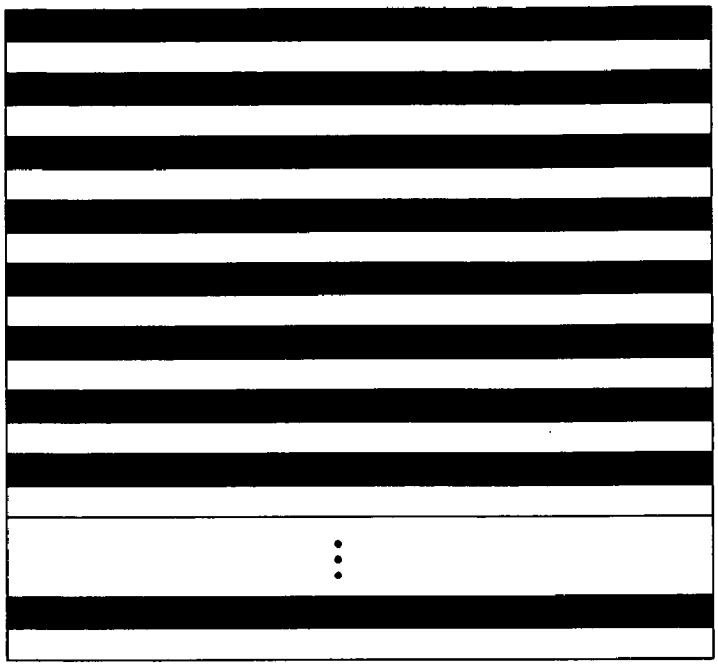
FIG. 6A and FIG. 6B show emission regions by the driving waveforms of FIG. 5A and FIG. 5B.

Then, predetermined light is generated only by the pixels 140 of the even horizontal lines in the $i^{th}$ frame. That is, the pixels 140 of the even horizontal lines generate light in response to the voltages charged in an $(i-1)^{th}$ frame (emission period: on) in a period where the voltages corresponding to the data signals are charged in the pixels 140 of the odd horizontal lines (non-emission period: off). Hence, the image display unit 130 generates light in the $i^{th}$ frame as shown in FIG. 6A.

Referring to FIG. 5B, scan signals are sequentially supplied to the even scan lines S2, S4, S6, . . . in the $(i+1)^{th}$ frame. At this time, data signals corresponding to the scan signals supplied to the even scan lines S2, S4, S6, . . . are supplied to the data lines D. Further, the emission control signals EMI are supplied to the even emission control signal lines Ee.

Figure 6B:
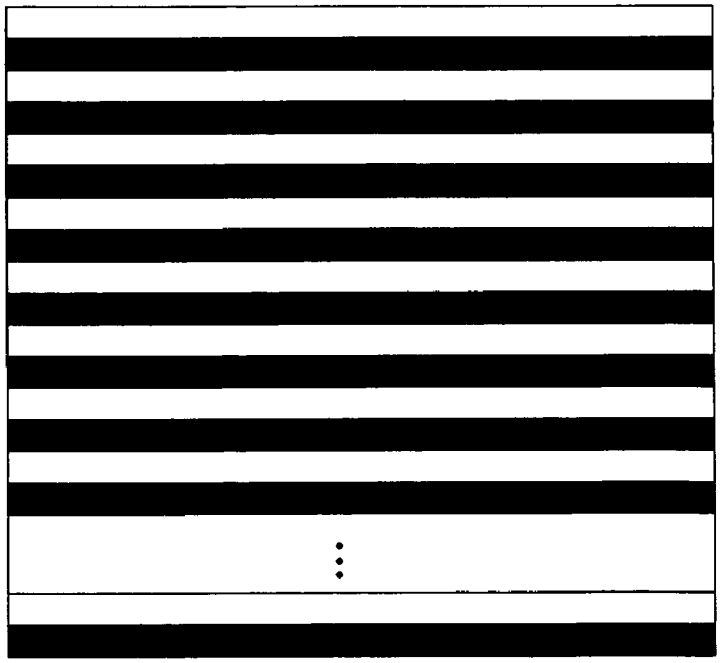

Then, predetermined light is generated only by the pixels 140 of the odd horizontal lines in the $(i+1)^{th}$ frame. That is, the pixels 140 of the odd horizontal lines generate light in response to the voltages charged in the $i^{th}$ frame in a period where the voltages corresponding to the data signals are charged in the pixels 140 of the even horizontal lines. Hence, the display unit 130 generates light in the $(i+1)^{th}$ frame as shown in FIG. 6B.

That is, according to an exemplary embodiment of the present invention, the pixels of the even horizontal lines emit light in the $i^{th}$ frame, and the pixels of the odd horizontal lines emit light in the $(i+1)^{th}$ frame. Accordingly, the change in the load of the first and third power sources ELVDDo and ELVDDe may be decreased so that it is possible to more uniformly display images of desired brightness. According to an exemplary embodiment of the present invention, since the power sources coupled with the pixels 140 to supply predetermined currents to the OLEDs include the first power source ELVDDo and the third power source ELVDDe, it is possible to reduce the amount of change in voltages.

Alternatively, predetermined spare time may be generated after supplying the scan signals in the $i^{th}$ and $(i+1)^{th}$ frames. According to an exemplary embodiment of the present invention, all pixels may emit light in the spare time, which will be described in detail below with references to FIG. 7A and FIG. 7B.

Figure 7A:
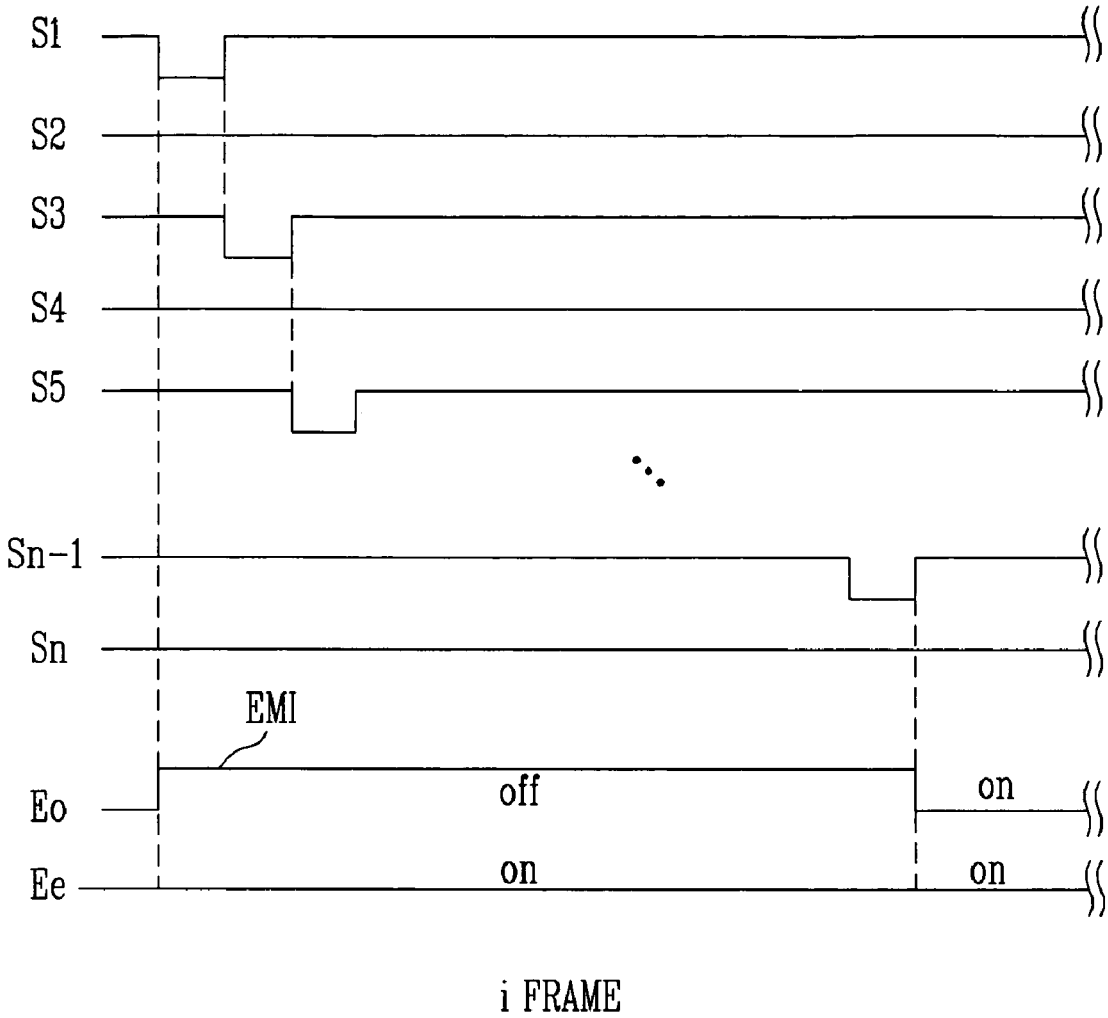
FIG. 7A and FIG. 7B show waveforms for describing a method of driving an organic light emitting display according to an exemplary embodiment of the present invention.
Figure 8A:
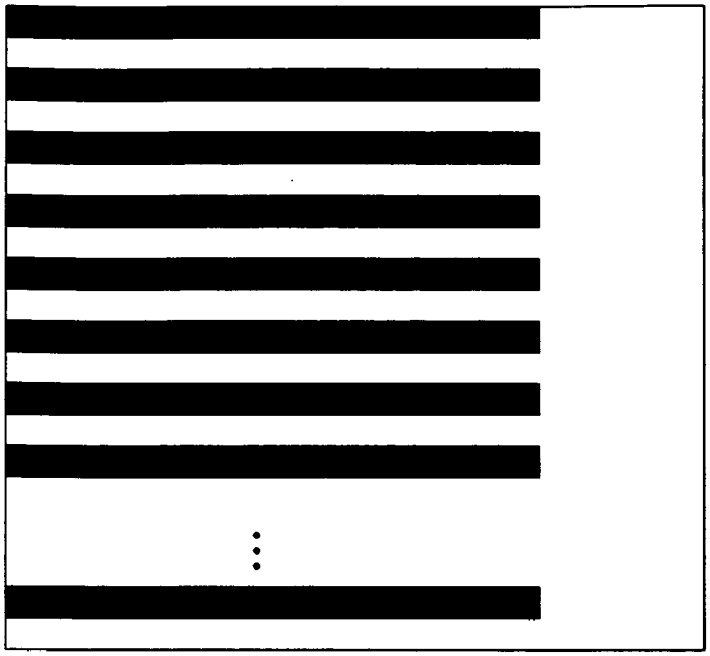
FIG. 8A and FIG. 8B show emission regions by the driving waveforms of FIG. 7A and FIG. 7B.

Referring to FIG. 7A, scan signals are sequentially supplied to the odd scan lines S1, S3, S5, . . . in the $i^{th}$ frame. While scanning the odd scan lines, the emission control signals EMI are supplied to the odd emission control signal lines Eo. However, once all odd scan lines have been scanned, the emission control signals EMI are no longer supplied to the odd emission control signal lines Eo. Accordingly, as shown in FIG. 8A, predetermined light is generated by the pixels of the even horizontal lines while scanning the odd scan lines, and then predetermined light is generated by all pixels after all odd scan lines have been scanned.

Figure 7B:
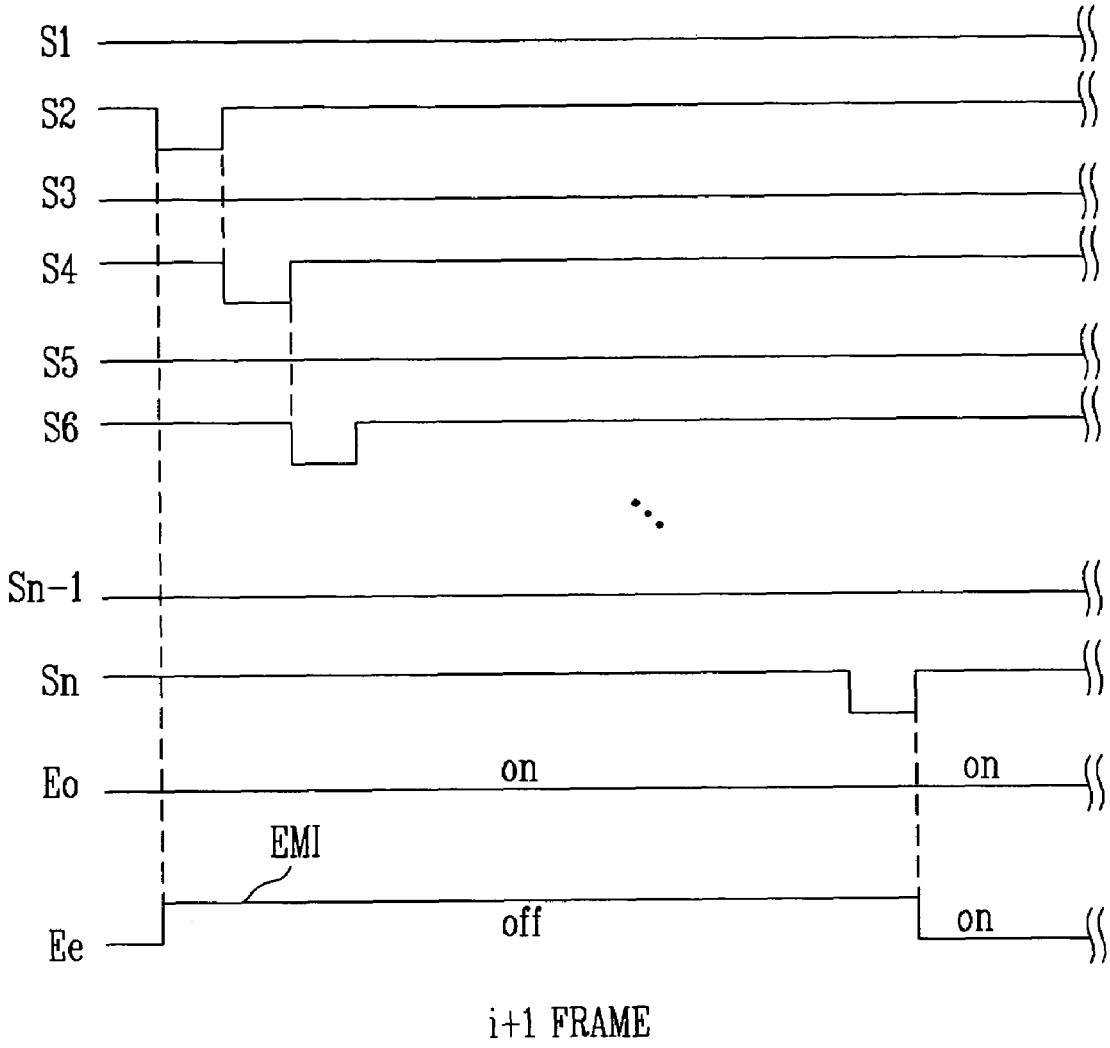
Figure 8B:
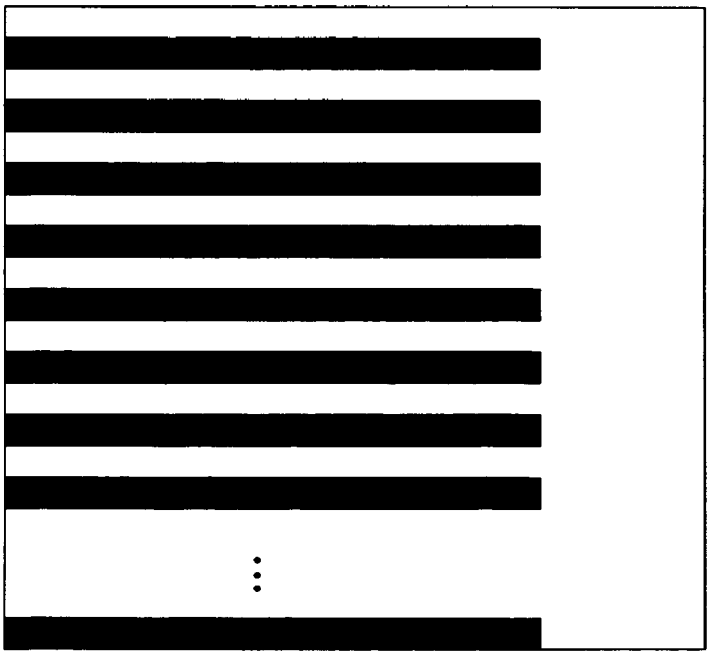

Referring to FIG. 7B, scan signals are sequentially supplied to the even scan lines S2, S4, S6, . . . in the $(i+1)^{th}$ frame. While scanning the even scan lines, the emission control signals EMI are supplied to the even emission control signal lines Ee. However, once all even scan lines have been scanned, the emission control signals EMI are no longer supplied to the even emission control signal lines Ee. Accordingly, as shown in FIG. 8B, predetermined light is generated by the pixels of the odd horizontal lines while scanning the even scan lines, and then predetermined light is generated by all pixels after all even scan lines have been scanned.

Figure 9:
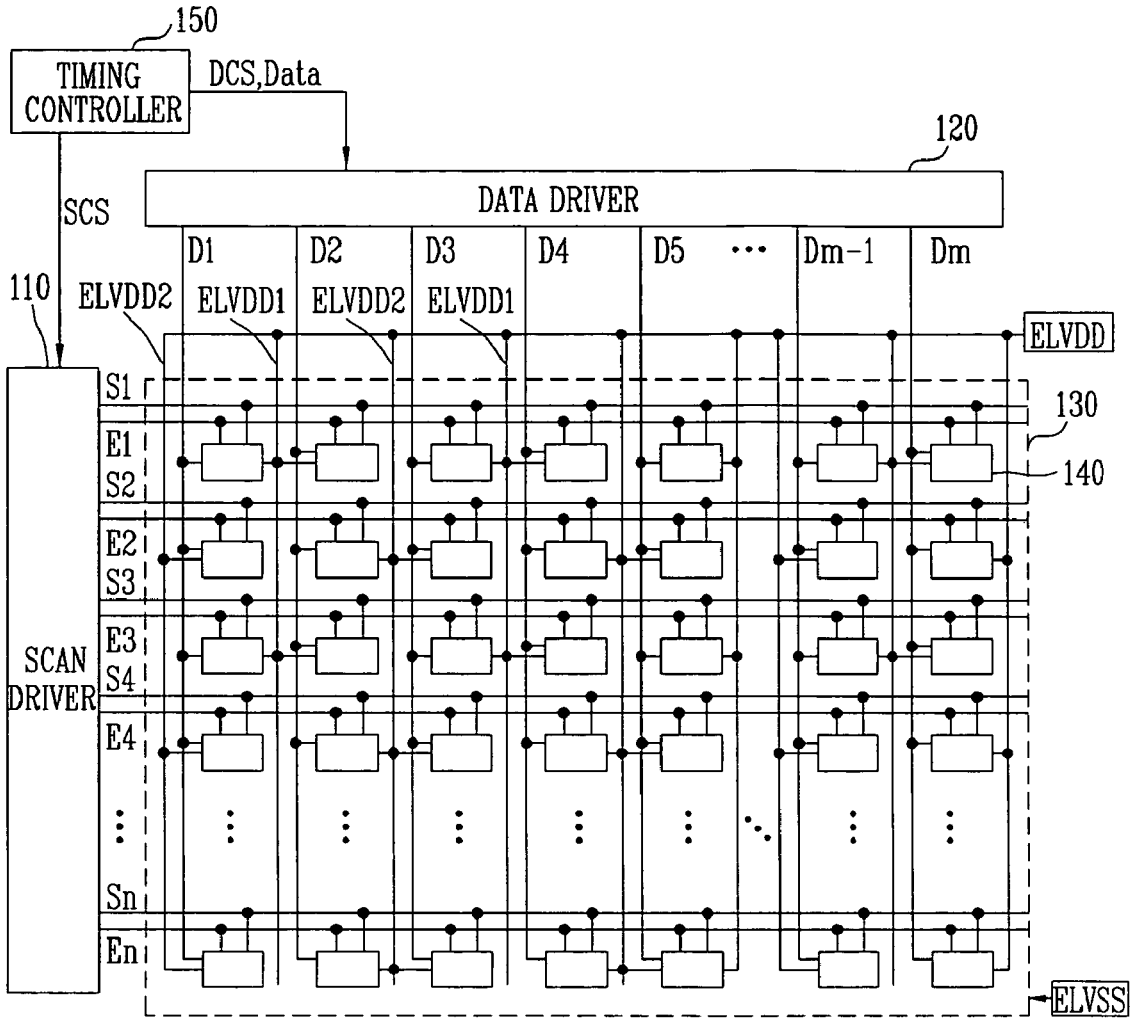
FIG. 9 shows an organic light emitting display according to a third exemplary embodiment of the present invention.

FIG. 9 shows an organic light emitting display according to another exemplary embodiment of the present invention. Referring to FIG. 9, the pixels 140 may be coupled with one first power source ELVDD. Specifically, the pixels 140 of the odd horizontal lines are coupled with the first power source lines ELVDD1, and the pixels 140 of the even horizontal lines are coupled with the second power source lines ELVDD2. The first and second power source lines ELVDD1 and ELVDD2 are coupled with the first power source ELVDD.

As shown in FIG. 5A and FIG. 5B, as well as FIG. 7A and FIG. 7B, the pixels 140 of the odd horizontal lines and the pixels 140 of the even horizontal lines are alternately driven. Hence, the change in the load applied to the first power source ELVDD may be minimized so that it is possible to improve display quality.

According to another exemplary embodiment of the present invention, all pixels 140 may be coupled with the first power source lines ELVDD1, which are coupled with the first power source ELVDD. Even when all pixels 140 are coupled with the first power source ELVDD, since the pixels 140 of the odd horizontal lines and the pixels 140 of the even horizontal lines are alternately driven, it may be possible to decrease the change in the load applied to the first power source ELVDD, thereby improving display quality.

As noted above, various pixel structures may be used for the pixels 140 of FIG. 2 and FIG. 3.

Figure 10:
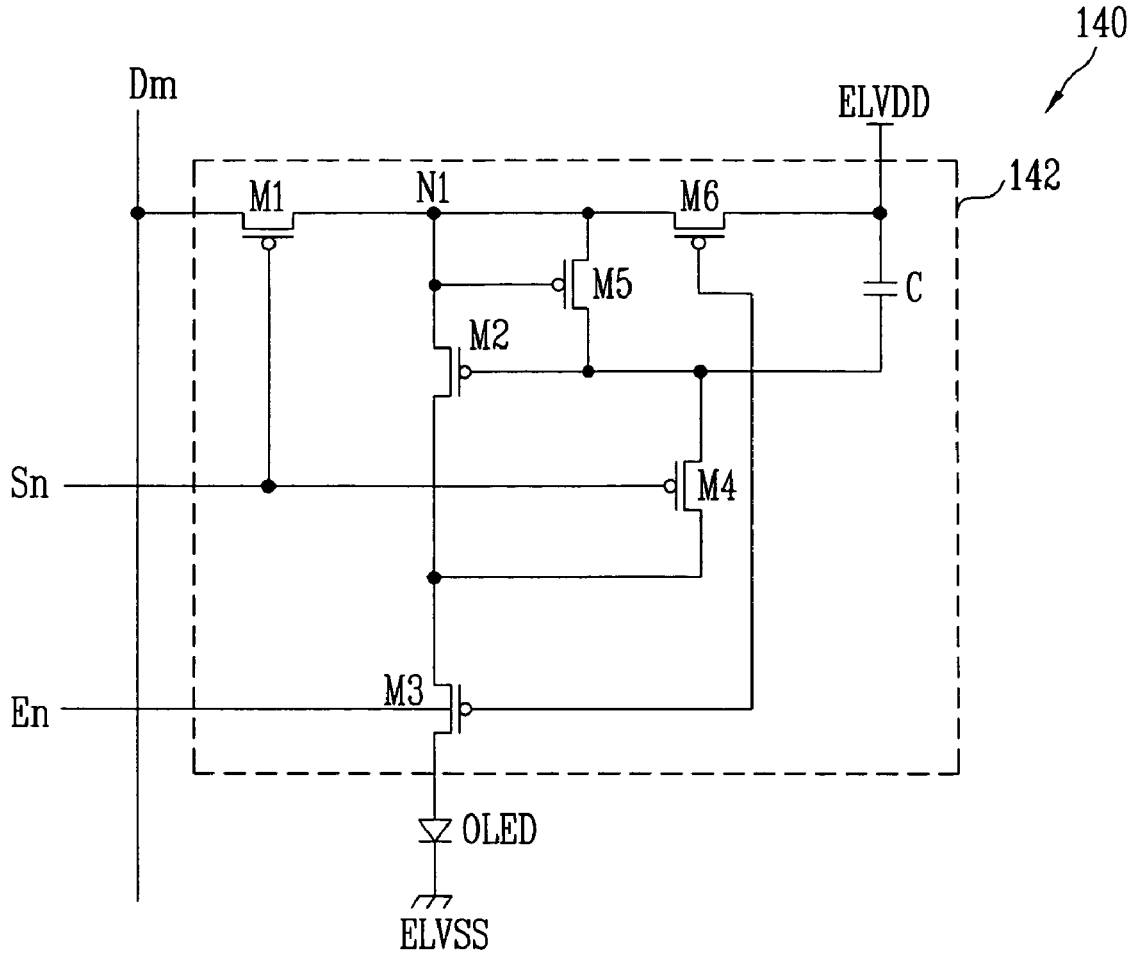
FIG. 10 shows another exemplary pixel structure for the pixel of FIG. 2.

FIG. 10 is a circuit diagram showing another example of a pixel structure that may be used for the pixels 140.

Referring to FIG. 10, the pixels 140 include an OLED and a pixel circuit 142. The pixel circuit 142 is coupled with a data line Dm, a scan line Sn, and an emission control signal line En to control the OLED.

The OLED's anode is coupled with the pixel circuit 142, and its cathode is couples with a second power source ELVSS. The OLED generates light corresponding to the current supplied from the pixel circuit 142.

The pixel circuit 142 includes first and sixth transistors M1 and M6 coupled between a first power source ELVDD and the data line Dm, a third transistor M3 coupled with the OLED and the emission control signal line En, a second transistor M2 coupled between the third transistor M3 and a first node N1, a fifth transistor M5 having a first terminal and gate terminal coupled with the first node N1 and a second terminal coupled with the gate terminal of the second transistor M2, and a fourth transistor M4 coupled between the gate terminal and the second terminal of the second transistor M2.

The first terminal of the first transistor M1 is coupled with the data line Dm, and the second terminal of the first transistor M1 is coupled with the first node N1. The gate terminal of the first transistor M1 is coupled with the scan line Sn. The first transistor M1 is turned on when the scan signal is supplied to the scan line Sn to supply an initialization signal and the data signal from the data line Dm to the first node N1.

The first terminal of the second transistor M2 is coupled with the first node N1, and the gate terminal of the second transistor M2 is coupled with the storage capacitor C. The second terminal of the second transistor M2 is coupled with the first terminal of the third transistor M3. The second transistor M2 supplies the current corresponding to the voltage charged in the storage capacitor C to the OLED.

The first terminal of the third transistor M3 is coupled with the second terminal of the second transistor M2, and the gate terminal of the third transistor M3 is coupled with the emission control signal line En. The second terminal of the third transistor M3 is coupled with the OLED. The third transistor M3 is turned on when the emission control signal EMI is not supplied to the emission control signal line En to transmit the current supplied from the second transistor M2 to the OLED.

The second terminal of the fourth transistor M4 is coupled with the gate terminal of the second transistor M2, and the first terminal of the fourth transistor M4 is coupled with the second terminal of the second transistor M2. The gate terminal of the fourth transistor M4 is coupled with the scan line Sn. The fourth transistor M4 is turned on when the scan signal is supplied to the scan line Sn so that electric current flows through the second transistor M2. Therefore, the second transistor M2 may operate as a diode.

The gate terminal and first terminal of the fifth transistor M5 are coupled with the first node N1, and the second terminal of the fifth transistor M5 is coupled with the gate terminal of the second transistor M2. That is, electric current flows through the fifth transistor M5 so that the fifth transistor M5 operates as a diode to supply an initializing voltage from the data line Dm to the gate terminal of the second transistor M2.

The second terminal of the sixth transistor M6 is coupled with the first node N1, and the first terminal of the sixth transistor M6 is coupled with the first power source ELVDD. The gate terminal of the sixth transistor M6 is coupled with the emission control signal line En. The sixth transistor M6 is turned on when the emission control signal EMI is not supplied to the emission control signal line En to electrically connect the first power source ELVDD and the first node N1 to each other.

Figure 11:
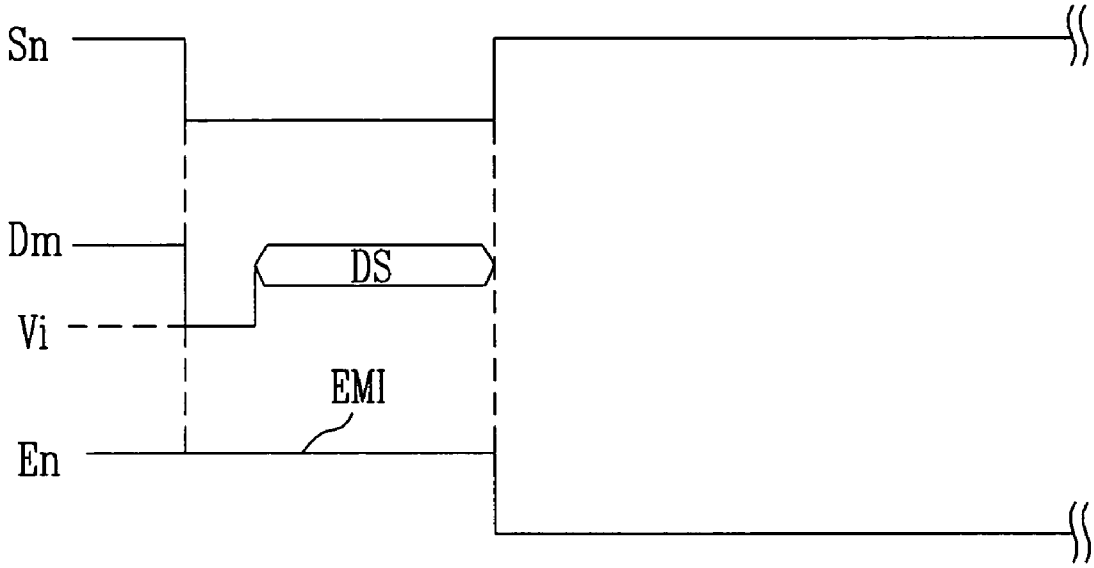
FIG. 11 shows driving waveforms that may be supplied to the pixel of FIG. 10.

The operation of the pixel circuit 142 of FIG. 10 will be described in detail with reference to FIG. 11. First, the scan signal is supplied to the scan line Sn, and an initializing voltage Vi is supplied to the data line Dm. At this time, the emission control signal EMI is supplied to the emission control signal line En so that the third and sixth transistors M3 and M6 are turned off.

When the scan signal is supplied to the nth scan line Sn, the first and fourth transistors M1 and M4 are turned on. When the first transistor M1 is turned on, the initializing voltage Vi is supplied to the first node N1 from the data line Dm. When the initializing voltage Vi is supplied to the first node N1, the fifth transistor M5, through which electric current flows to operate as a diode, is turned on so that the initializing voltage Vi is supplied to the gate terminal of the second transistor M2.

Here, the initializing voltage Vi is less than the voltage of the data signal. Specifically, as FIG. 11 shows, the initializing voltage Vi is less than the lowest data signal that the data driver 120 supplies. Therefore, when the initializing voltage Vi is supplied to the first node N1, the voltage of the gate terminal of the second transistor M2 is reduced to the initializing voltage Vi. Then, the second transistor M2 may be turned on regardless of the voltage of the data signal applied to the first node N1.

After supplying the initializing voltage Vi to the gate terminal of the second transistor M2, a data signal DS, which corresponds to a predetermined gray scale, is supplied to the data line Dm. The data signal DS is supplied to the first node N1 via the first transistor M1. At this time, since the gate terminal of the second transistor M2 is initialized by the initializing voltage Vi, the second transistor M2 is turned on. When the second transistor M2 is turned on, the data signal DS applied to the first node N1 is supplied to one side of the storage capacitor C via the second and fourth transistors M2 and M4. At this time, the data signal DS, whose voltage is reduced by the voltage corresponding to the threshold voltage Vth of the second transistor M2, is supplied to one side of the storage capacitor C, and a voltage corresponding to the data signal DS, as reduced by the threshold voltage Vth of the second transistor M2, is charged in the storage capacitor C.

The emission control signal EMI (the odd or even emission control signal) supplied to the nth emission control signal line En is turned off so that the fourth and sixth transistors M4 and M6 may be turned on. When the fourth and sixth transistors M4 and M6 are turned on, the current corresponding to the voltage charged in the storage capacitor C is supplied to the OLED via the second transistor M2 and the third transistor M3 so that light corresponding to the data signal DS may be generated by the OLED.

As described above, with an organic light emitting display according to exemplary embodiments of the present invention, and a method of driving the same, some pixels emit light in the $i^{th}$ (i is a natural number) frame and the other pixels emit light in the $(i+1)^{th}$ frame. When the pixels alternately emit light in the ith and i+1th frames, it is possible to prevent images from being non-uniform in accordance with changes in the first power source and to minimize the amount of change in the load (the voltage) of the first power source ELVDD. Also, according to embodiments of the present invention, the power source for supplying predetermined currents to the OLEDs may be divided into two power sources. Hence, the number of pixels coupled with the divided power sources may be decreased so that it is possible to decrease the amount of change in voltage of the divided power sources, thereby improving display quality.

It will be apparent to those skilled in the art that various modifications and variation can be made in the present invention without departing from the spirit or scope of the invention. Thus, it is intended that the present invention cover the modifications and variations of this invention provided they come within the scope of the appended claims and their equivalents.

What is claimed is:

1. An organic light emitting display, comprising:

a scan driver for sequentially supplying scan signals to odd scan lines in an $i^{th}$ frame and for sequentially supplying scan signals to even scan lines in an $(i+1)^{th}$ frame, i being a natural number;

a data driver for supplying data signals corresponding to the scan signals supplied to the odd scan lines in the $i^{th}$ frame and for supplying data signals corresponding to the scan signals supplied to the even scan lines in the $(i+1)^{th}$ frame, the data signals being supplied to data lines;

an image display unit including a plurality of pixels coupled with the scan lines and the data lines;

first power source lines coupled with pixels of odd horizontal lines;

second power source lines coupled with pixels of even horizontal lines; and a first power source coupled with the first power source lines and the second power source lines, wherein the scan driver supplies emission control signals to odd emission control signal lines so that pixels coupled with the odd scan lines do not emit light in a period where the scan signals are supplied to the odd scan lines, and wherein the scan driver supplies emission control signals to even emission control signal lines so that pixels coupled with the even scan lines do not emit light in a period where the scan signals are supplied to the even scan lines.

2. The organic light emitting display of claim 1, wherein the scan driver does not supply the emission control signals to the even emission control signal lines so that the pixels coupled with the even scan lines emit light in the period where the scan signals are supplied to the odd scan lines, and wherein the scan driver does not supply the emission control signals to the odd emission control signal lines so that the pixels coupled with the odd scan lines emit light in the period where the scan signals are supplied to the even scan lines.

3. The organic light emitting display of claim 1, wherein the scan driver does not supply the emission control signals to the odd and even emission control signal lines in a period, excluding the period in which the scan signals are supplied to the odd scan lines in the $i^{th}$ frame.

4. The organic light emitting display of claim 1, wherein the scan driver does not supply the emission control signals to the odd and even emission control signal lines in a period, excluding the period in which the scan signals are supplied to the even scan lines in the $(i+1)^{th}$ frame.

5. The organic light emitting display of claim 3, wherein all pixels included in the image display unit emit light in response to the data signals when the emission control signals are not supplied to the odd and even emission control signal lines.

6. The organic light emitting display of claim 4, wherein all pixels included in the image display unit emit light in response to the data signals when the emission control signals are not supplied to the even and odd emission control signal lines.

7. The organic light emitting display of claim 1, wherein a pixel comprises:

an organic light emitting diode (OLED);

a second transistor for supplying current to the OLED in accordance with a data signal;

a first transistor coupled with a scan line and a data line to transmit the data signal to the second transistor when a scan signal is supplied to the scan line;

a storage capacitor coupled with the second transistor to charge a voltage corresponding to the data signal;

a third transistor coupled with an emission control signal line to supply the current supplied from the second transistor to the OLED when an emission control signal is not supplied to the emission control signal line; and a second power source coupled with a cathode of the OLED.

8. The organic light emitting display of claim 7, further comprising:

a third power source coupled with the second power source lines.

9. The organic light emitting display of claim 8, wherein the first power source and the third power source have substantially the same voltage value.

10. The organic light emitting display of claim 8, wherein the pixels of the odd horizontal lines are coupled with the odd scan lines and the odd emission control signal lines, and wherein the pixels of the even horizontal lines are coupled with the even scan lines and the even emission control signal lines.

11. The organic light emitting display of claim 1, wherein the pixels of the odd horizontal lines are coupled with the odd scan lines and the odd emission control signal lines, and wherein the pixels of the even horizontal lines are coupled with the even scan lines and the even emission control signal lines.

12. The organic light emitting display of claim 7, wherein the pixel further comprises:

a fourth transistor coupled between a gate terminal and a second terminal of the second transistor, the fourth transistor being controlled by the scan signal;

a fifth transistor whose first terminal and gate terminal are coupled with a second terminal of the first transistor and whose second terminal is coupled with the gate terminal of the second transistor; and a sixth transistor coupled between the second terminal of the first transistor and the storage capacitor, the sixth transistor being controlled by the emission control signal.

13. A method of driving an organic light emitting display, comprising:

supplying scan signals to odd scan lines in an $i^{th}$ frame;

not emitting light from pixels coupled with the odd scan lines in a period where the scan signals are supplied to the odd scan lines;

supplying scan signals to even scan lines in an $(i+1)^{th}$ frame;

not emitting light from pixels coupled with the even scan lines in a period where the scan signals are supplied to the even scan lines, wherein i is a natural number;

connecting a first power source to first power source lines and second power source lines;

connecting the first power source lines to pixels of odd horizontal lines; and connecting the second power source lines to pixels of even horizontal lines.

14. The method of claim 13, further comprising:

emitting light from the pixels coupled with the even scan lines in the period where the scan signals are supplied to the odd scan lines; and emitting light from the pixels coupled with the odd scan lines in the period where the scan signals are supplied to the even scan lines.

15. The method of claim 13, further comprising:

emitting light from all pixels in a period, excluding the period in which the scan signals are supplied to the odd scan lines in the $i^{th}$ frame.

16. The method of claim 13, further comprising:

emitting light from all pixels in a period, excluding the period in which the scan signals are supplied to the even scan lines in the $(i+1)^{th}$ frame.

17. The method of claim 13, further comprising:

supplying data signals, corresponding to the scan signals supplied to the odd scan lines, to data lines in the $i^{th}$ frame; and supplying data signals, corresponding to the scan signals supplied to the even scan lines, to the data lines in the $i+1)^{th}$ frame.

18. A method of driving an organic light emitting display, comprising:

connecting a first power source to first power source lines and second power source lines;

connecting the first power source lines to pixels of odd horizontal lines; and connecting the second power source lines to pixels of even horizontal lines;

emitting light from first pixels in a period where scan signals are supplied in a first frame; and emitting light from second pixels in a period where scan signals are supplied in a second frame, wherein the first pixels and the second pixels are exclusive of each other.

19. The method of claim 18, wherein the scan signals supplied in the first frame are supplied to odd scan lines.

20. The method of claim 19, wherein the first pixels are coupled with even scan lines.

21. The method of claim 18, wherein the scan signals supplied in the second frame are supplied to even scan lines.

22. The method of claim 21, wherein the second pixels are coupled with odd scan lines.

23. The method of claim 18, further comprising:

emitting light from the first pixels and the second pixels in response to data signals in a period, excluding the period in which the scan signals are supplied in the first and second frames.

* * * * *